US009632484B2

(12) United States Patent
Feldbausch et al.

(10) Patent No.: US 9,632,484 B2
(45) Date of Patent: Apr. 25, 2017

(54) TIMEPIECE COMPRISING A CHIMING DEVICE

(71) Applicants: Michael Feldbausch, Carouge (CH); Cedric Johner, Thonex (CH); Giulio Papi, La Chaux-de-Fonds (CH)

(72) Inventors: Michael Feldbausch, Carouge (CH); Cedric Johner, Thonex (CH); Giulio Papi, La Chaux-de-Fonds (CH)

(73) Assignee: Feldbausch & Cie AG (CH)

( * ) Notice: Subject to any disclaimer, the term of this patent is extended or adjusted under 35 U.S.C. 154(b) by 0 days.

(21) Appl. No.: 14/783,831

(22) PCT Filed: Apr. 8, 2014

(86) PCT No.: PCT/IB2014/000509

§ 371 (c)(1),
(2) Date: Oct. 21, 2015

(87) PCT Pub. No.: WO2014/167404

PCT Pub. Date: Oct. 16, 2014

(65) Prior Publication Data

US 2016/0054705 A1 Feb. 25, 2016

(30) Foreign Application Priority Data

Apr. 11, 2013 (CH) ..... 753/13

(51) Int. Cl.

| | |
|---|---|
| ***G04B 21/06*** | (2006.01) |
| ***G04B 21/08*** | (2006.01) |
| ***G04B 21/04*** | (2006.01) |
| *G04B 23/02* | (2006.01) |

(52) U.S. Cl.

CPC ..... *G04B 21/04* (2013.01); *G04B 21/06* (2013.01); *G04B 21/08* (2013.01); *G04B 23/026* (2013.01); *G04B 23/028* (2013.01)

(58) Field of Classification Search

CPC ..... G04B 21/00; G04B 21/02; G04B 21/04; G04B 21/06; G04B 23/025; G04B 23/026; G04B 21/08

See application file for complete search history.

(56) References Cited

U.S. PATENT DOCUMENTS

| | | | | |
|---|---|---|---|---|
| 370,219 A | | 9/1887 | Sullivan | |
| 2,127,635 A | * | 8/1938 | Warshawsky | G04C 21/08 368/270 |
| 2,742,875 A | * | 4/1956 | Junghans | G04B 21/08 116/169 |

(Continued)

FOREIGN PATENT DOCUMENTS

| | | |
|---|---|---|
| CH | 699894 | 5/2010 |
| EP | 2290479 | 3/2011 |
| EP | 2290480 | 3/2011 |

*Primary Examiner* — Vit W Miska

(74) *Attorney, Agent, or Firm* — Galbreath Law Offices, P.C.; John A. Galbreath

(57) ABSTRACT

A timepiece comprises a chiming device including at least one pivoting toothed sector called rack (1) intended to cooperate with at least one first part (2), driving a second part (3) secured to a pin (32) cooperating with an eccentric (41) for actuating at least one hammer (4) characterized in that the hammer (4) chimes a gong (5) extending substantially in a plane A by being displaced along a plane B which intercepts the plane A of the gong (5).

9 Claims, 4 Drawing Sheets

(56) References Cited

U.S. PATENT DOCUMENTS

| | | | | |
|---|---|---|---|---|
| 3,702,529 | A * | 11/1972 | Zeter | G04C 21/10 368/270 |
| 4,247,933 | A * | 1/1981 | Nakamura | G04B 21/022 340/393.4 |
| 7,021,819 | B2 * | 4/2006 | Schmiedchen | G04B 23/02 368/147 |
| 7,773,463 | B2 * | 8/2010 | Corthesy | G04B 21/04 368/75 |
| 2011/0032803 | A1 * | 2/2011 | Journe | G04B 21/12 368/72 |
| 2011/0051567 | A1 * | 3/2011 | Karapatis | G04B 21/06 368/273 |
| 2011/0110200 | A1 * | 5/2011 | Goeller | G04B 21/08 368/243 |

* cited by examiner

TIMEPIECE COMPRISING A CHIMING DEVICE

The present invention relates to a timepiece including a mechanical chiming device.

It is already known from the state of the technique chiming mechanisms, in particular minute repeating, for mechanical watches. Particularly, it is worth noting that such a standard timepiece includes a movement and a chiming mechanism to chime current time quarters by two different sounds. The chiming mechanism comprises:

- a source of energy,
- a snail driven by the movement to provide information about the current time quarters,
- a feeler-spindle for cooperating with this snail to gather information on the current time quarters, a first and a second pallet for respectively actuating a first and a second hammer intended to respectively chime a first and a second gong.

In this conventional embodiment, the hammers pivot in a plane which is parallel with the plane of the gong, thus, in particular for a space gain in terms of watch thickness.

EP2290479 describes a watch including a chiming device comprising a gong having a bar surrounding a movement and extending substantially in a plane, a gong-carrier secured to a frame of the watch, the gong being secured on the gong-carrier, at least a hammer for chiming the gong so as to produce a vibration of said gong, characterized in that the hammer is arranged to come and chime an impact surface of the gong which is slanting with respect to the horizontal to said plane. Contrary to the present invention, the impact direction in other words the direction of the hammer movement, is parallel to the plane of the gong.

The purpose of the present invention is to create timepieces including an innovative mechanical chiming device with a powerful aesthetic effect.

In accordance with the invention, a timepiece comprising a geometric centre comprises a chiming device comprising a hammer actuating device. This device comprisess at least one pivoting toothed sector know as a rack intended to cooperate with at least one first component, the said first component driving a second component secured to a pin cooperating with a third component to actuate, at least one hammer, which is designed to strike a chime extending substantially in a plane A and moving in a plane B that intercepts the plane A of the chime.

The timepiece according to the invention comprises two hammers arranged parallel to one another and distributed in directions essentially parallel to a radius extending from the said geometric centre of the timepiece.

The two chimes which each comprise a circumferential segment placed on a circumferential part of the timepiece and a rectilinear part, the two chimes being arranged on either side with respect to the said radius, with the two rectilinear parts arranged essentially parallel to said radius and with the two circumferential segments extending in the said plane A in two opposite directions away from the said radius.

The two hammers are arranged parallel to and close to the rectilinear parts of the chimes and each hammer being designed to pivot about an axis of rotation parallel to the said plane A so that the hammer strikes the chime by moving in a direction perpendicular with respect to the plane A of the said chime.

Such a chiming device may be used for any type of chiming work, such as for example a chiming work for the hours, a chiming work for the minutes, a chiming work for the quarters and thus, whatever the considered configuration (chiming work in passing, upon request, . . . ) or for a melody.

The features of the invention will appear more clearly upon reading several embodiments given only by way of example, in no way limiting and with reference to the schematic figures, in which.

The following description, relates to a chiming mechanism for chiming the quarters, and it is given by way of example and serves as support for the present invention.

Figure 1:
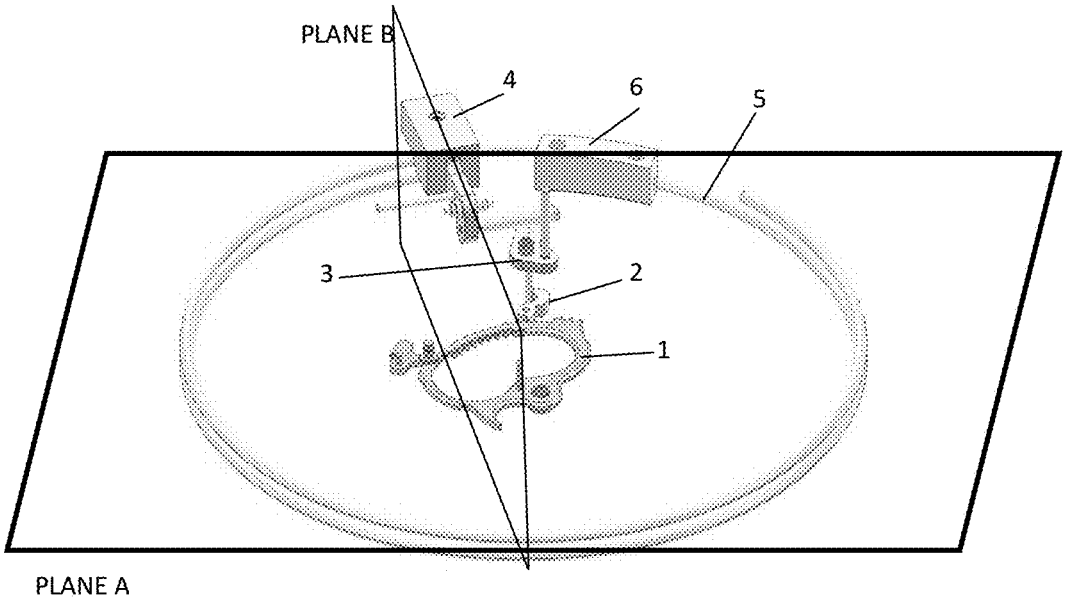
FIG. 1 represents a perspective view of the main elements of the chiming device according to the invention.

According to FIG. 1, the wrist-watch comprises a chiming device comprising a hammer including a quarter-rack 1, a quarter chime gathering pallet 2, a reverser pallet 3, a hammer 4 and a gong 5. In the rest of the description, the plane of the gong 5 will be called plane A and the plane in which the hammer 4 is displaced, plane B.

FIGS. 2 to 5 illustrate details of a chiming device applicable to a timepiece according to the invention.

Figure 2:
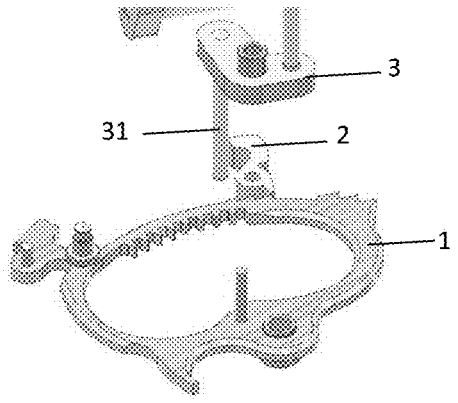
FIG. 2 represents a perspective view of the quarter-rack, driving the quarter chime gathering pallet bringing the reverser pallet.

As illustrated on FIG. 2, at least one pivoting rack 1 is intended to cooperate with at least one first part 2, called quarter chime gathering pallet.

Figure 4:
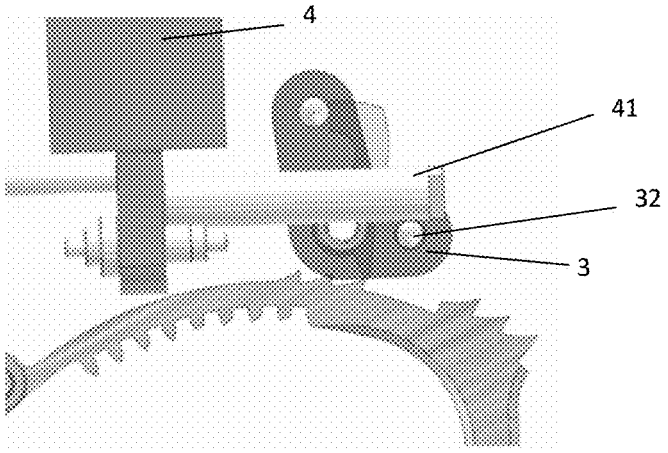
FIG. 4 is a top view of a pin, driving the hammer by means of the eccentric.

The quarter chime gathering pallet 2 drives a second part 3, called reverser pallet and is secured to a pin 32 cooperating with a third part 41, secured to the hammer 4, to actuate at least one hammer 4 (FIG. 4). This third part 41 may for example be a pin or an eccentric as illustrated in FIG. 4.

Figure 5:
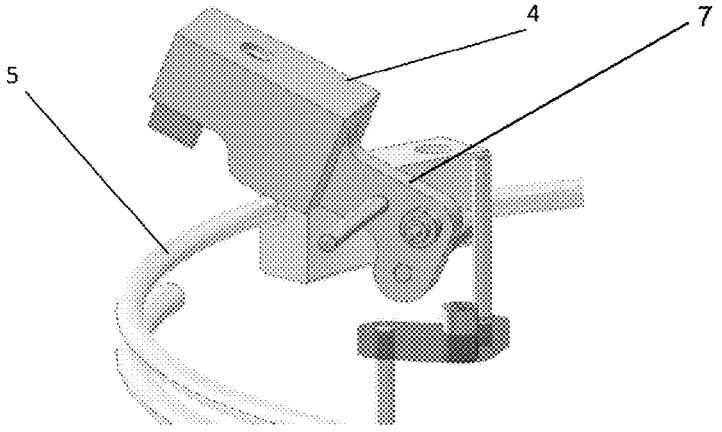
FIG. 5 represents a perspective view of a hammer chiming a gong according to the invention.

This device drives the hammer 4 which chimes a gong 5 extending substantially in a plane A by being displaced along a plane B which intercepts the plane A of the gong 5. Indeed, the hammer 4 chimes the gong 5 being displaced, preferably, according to a direction which is perpendicular with respect to plane A of said gong 5 (FIG. 5).

Figure 3:
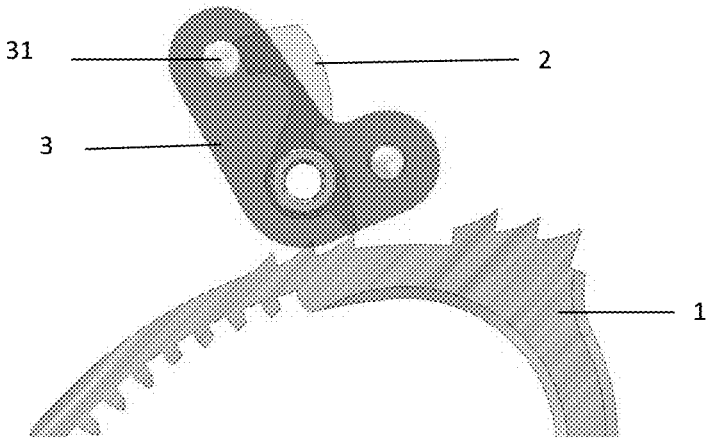
FIG. 3 is a top view of the quarter chime gathering pallet, and of the reverser pallet.

As visibly illustrated, in particular on FIG. 3, the rack 1 is a quarter-rack including a first and a second set of three teeth.

According to this embodiment, the quarter chime gathering pallet 2 and the reverser pallet 3 are coaxial (FIG. 3).

Figure 6:
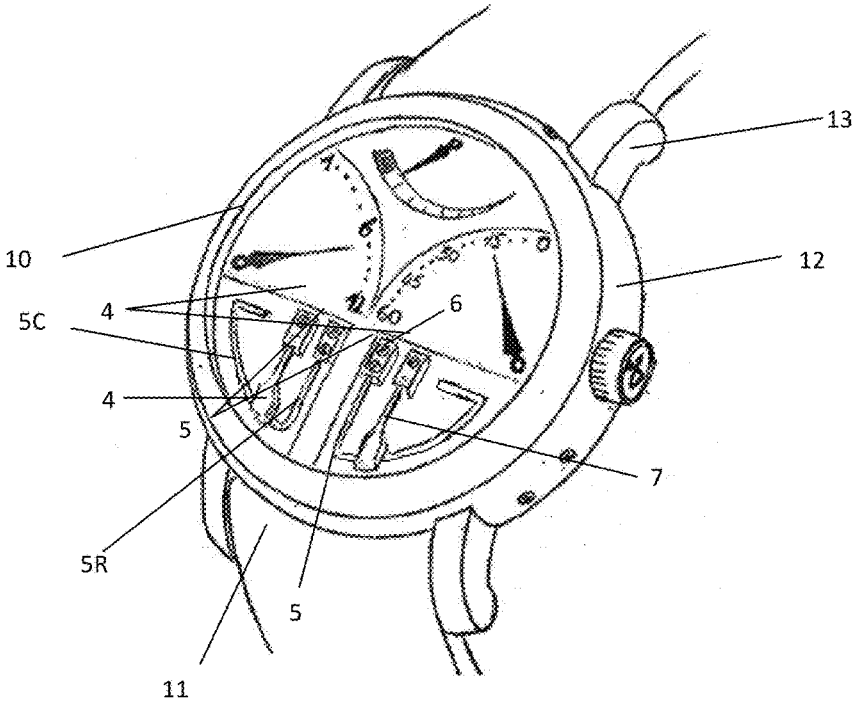
FIG. 6 represents a perspective view of a wrist-watch including two hammers disposed in parallel with each other.

As illustrated on FIG. 6, a wrist-watch according to the invention comprises a geometric centre comprising a chiming device comprising a device for actuating two hammers, each hammer 4 coming to vertically chime a very distinct gong 5.

Each chime 5 comprises a segment 5C placed on a circumferential part of the timepiece and a rectilinear part 5R. The rectilinear part 5R of each chime 5 is secured by one of its ends to a different chime carrier 6. The circumferential segments 5C extend in the plane A of the chime, one on one side of the two rectilinear part 5R and the other on the other side of the two rectilinear part 5R. Therefore the chimes 5 of a timepiece according to the invention do not surround the horological movement.

In the example of FIG. 6, the hammer 4 chimes the circumferential segment 5C of the chime 5.

The two hammers 4 and the two chimes 5 stand in a circular dial space 10. In this example, straight sections of the chimes 5R and the hammers are lined up, towards the periphery of the dial space 10, with a bracelet 11 carried by the watch case 12 by horns 13. Generally, the straight sections 5R of the chimes extend from the periphery of the circular dial space 10 towards the center.

The two gongs 5 of the above example are of the same length but in a variant, they can be of different length and secured to one or several gong-carriers 6.

Figure 7:
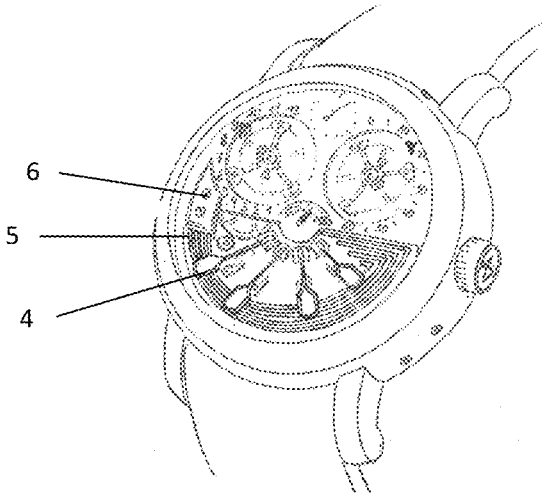
FIG. 7 represents a perspective view of a wrist-watch including several hammers.

In embodiment variant, illustrated on FIG. 7, several hammers 4 are distributed along radial directions around a geometrical center of the timepiece. In this embodiment, there are distinguished for example four hammers 4 which come to vertically chime four gongs 5. The four gongs 5 are secured at one of their ends to the same gong-carrier 6, opposite to FIG. 6 in which each gong 5 is secured by one of its ends to a different gong-carrier 6.

Figure 8:
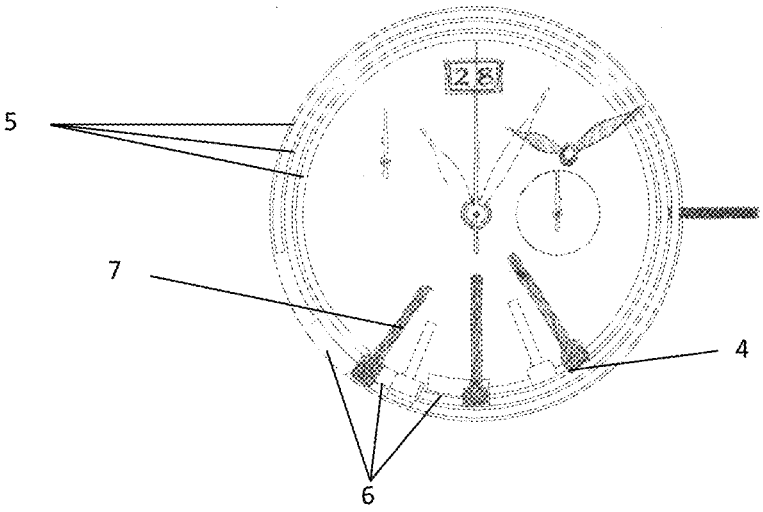
FIG. 8 represents a partial front view of a wrist-watch including several hammers coming to chime several gongs disposed on the circumference of the wrist-watch.

As illustrated on FIG. 8, a plurality of gongs 5 are disposed on the circumference of the timepiece and radially spaced apart from each other. Each gong 5 corresponds to a hammer 4 which extends to this gong 5. The hammers 4 may be of the same length or of different length as is the case in the illustrated example.

A simple variant is to provide a wrist-watch including such a chiming device in which one single hammer 4 would chime one single gong 5.

Each hammer 4 is constituted of a stem 7, said hammer 4 pivoting according to an axis of rotation located either at the free end of the stem 7 as illustrated for example on FIG. 5, or at an intermediate point of the length of the stem 7.

Based on the description which has just been made, several variants of the chiming mechanism of a timepiece provided with a hammer 4 may be considered.

The invention claimed is:

1. Timepiece comprising a geometric centre comprising a chiming device comprising a hammer actuating device, this device comprising at least one pivoting toothed sector known as a rack (1) intended to cooperate with at least one first component (2), the said first component driving a second component (3) secured to a pin (32) cooperating with a third component (41) to actuate at least one hammer (4) which is designed to strike a chime (5) extending substantially in a plane A and moving in a plane B that intercepts the plane A of the chime (5), characterized in that it comprises two hammers (4) arranged parallel to one another and distributed in directions essentially parallel to a radius extending from the said geometric centre of the timepiece, two chimes (5) which each comprise a circumferential segment (5C) placed on a circumferential part of the timepiece and a recti-linear part (5R), the two chimes (5) being arranged on either side with respect to the said radius, with the two rectilinear parts arranged essentially parallel to said radius and with the two circumferential segments (5C) extending in the said plane A in two opposite directions away from the said radius, the two hammers (4) being arranged parallel to and close to the rectilinear parts (5R) of the chimes (5), each hammer (4) being designed to pivot about an axis of rotation parallel to the said plane A so that the hammer (4) strikes the chime (5) by moving in a direction perpendicular with respect to the plane A of the said chime (5).

2. Timepiece comprising a chiming device according to claim 1, in which the rack (1) is a quarter rack comprising a first and a second series of teeth.

3. Timepiece comprising a chiming device according to claim 1, in which the first component (2) is a component known as a quarter pallet.

4. Timepiece comprising a chiming device according to claim 3, in which another pin (31) secured to the second component (3) is driven by the quarter pallet (2).

5. Timepiece comprising a chiming device according to claim 4, in which the second component (3) is a component known as a reverser pallet.

6. Timepiece comprising a chiming device according to claim 5, in which the quarter pallet (2) and the reverser pallet (3) are coaxial.

7. Timepiece comprising a chiming device according to claim 1, in which the hammer (4) strikes the circumferential segment (5C) of the chime (5).

8. Timepiece comprising a chiming device according to claim 1, comprising a hammer (4) consisting of a rod (7), the said hammer (4) pivoting about an axis of rotation situated either at the free end of the rod (7) or at an intermediate point along the length of the rod (7).

9. Timepiece comprising a chiming device according to claim 1, in the form of a wristwatch in which the two hammers (4) and the two chimes (5) fit into a circular dial space (10), the rectilinear parts (5R) of the chimes (5) extending from a point on the periphery of the circular dial space (10) towards the centre.

* * * * *